US009991068B2

(12) United States Patent
Amano et al.

(10) Patent No.: US 9,991,068 B2
(45) Date of Patent: Jun. 5, 2018

(54) PUSH-BUTTON SWITCH

(71) Applicants: CITIZEN ELECTRONICS CO., LTD., Yamanashi-ken (JP); CITIZEN WATCH CO., LTD., Tokyo (JP)

(72) Inventors: Toyohiko Amano, Yamanashi-ken (JP); Mitsunori Miura, Yamanashi-ken (JP)

(73) Assignees: CITIZEN ELECTRONICS CO., LTD., Yamanashi-Ken (JP); CITIZEN WATCH CO., LTD., Tokyo (JP)

( * ) Notice: Subject to any disclaimer, the term of this patent is extended or adjusted under 35 U.S.C. 154(b) by 0 days. days.

(21) Appl. No.: 15/124,862

(22) PCT Filed: Mar. 5, 2015

(86) PCT No.: PCT/JP2015/056455

§ 371 (c)(1),
(2) Date: Sep. 9, 2016

(87) PCT Pub. No.: WO2015/137220

PCT Pub. Date: Sep. 17, 2015

(65) Prior Publication Data

US 2017/0213662 A1 Jul. 27, 2017

(30) Foreign Application Priority Data

Mar. 11, 2014 (JP) ..... 2014-047188
Mar. 26, 2014 (JP) ..... 2014-063163

(51) Int. Cl.
*H01H 13/14* (2006.01)
*H01H 13/06* (2006.01)
(Continued)

(52) U.S. Cl.
CPC ..... *H01H 13/06* (2013.01); *H01H 1/5805* (2013.01); *H01H 13/04* (2013.01); *H01H 13/14* (2013.01)

(58) Field of Classification Search
CPC .. H01H 13/04; H01H 13/14; H01H 2207/004; H01H 1/5805
(Continued)

(56) References Cited

U.S. PATENT DOCUMENTS 7,906,741 B2 * 3/2011 Yanai ..... H01H 13/18 200/406
2001/0013466 A1 * 8/2001 Yanai ..... H01H 1/5805 200/406
2009/0200147 A1 8/2009 Watanabe

FOREIGN PATENT DOCUMENTS

CN 202258868 5/2012
JP 60-3621 1/1985
(Continued)

OTHER PUBLICATIONS

The First Office Action dated Apr. 6, 2017 in corresponding Chinese Application No. 201580012846.X, with English translation.
(Continued)

*Primary Examiner* — Renee S Luebke
*Assistant Examiner* — Ahmed Saeed
(74) *Attorney, Agent, or Firm* — Wenderoth, Lind & Ponack, L.L.P.

(57) ABSTRACT

A side-push push-button switch is provided in which the strength of a rear surface side of a housing to which a load is particularly applied by outside force caused by the switching operation of a push-button member is increased to stably mount the housing on a circuit board and ensure reliable and secure switching operation. The push-button switch includes a housing, a push-button member, and a holding frame. The housing accommodates a switch contact. The push-button member is disposed on a front-surface center portion of the housing and configured to press the switch contact. The holding frame of a channel shape covers outer surfaces of
(Continued)

the housing. Both ends of the holding frame are secured to front-surface side portions of the housing on both sides of the push-button member.

11 Claims, 5 Drawing Sheets

(51) Int. Cl.
*H01H 1/58* (2006.01)
*H01H 13/04* (2006.01)

(58) Field of Classification Search
USPC ..... 200/341, 520, 294, 293
See application file for complete search history.

(56) References Cited

FOREIGN PATENT DOCUMENTS

| | | |
|---|---|---|
| JP | 61-197620 | 12/1986 |
| JP | 10-125164 | 5/1998 |
| JP | 2004-79220 | 3/2004 |
| JP | 2004-207057 | 7/2004 |
| JP | 2005-209565 | 8/2005 |
| JP | 2006-19151 | 1/2006 |
| JP | 2006-244977 | 9/2006 |
| JP | 2007-324090 | 12/2007 |
| JP | 2009-193773 | 8/2009 |

OTHER PUBLICATIONS

Notice of Final Rejection dated Mar. 21, 2017 in corresponding Korean Application No. 10-2016-7015953, with English translation.
International Search Report dated May 19, 2015 in International Application No. PCT/JP2015/056455.
Written Opinion of the International Searching Authority dated May 19, 2015 International Application No. PCT/JP2015/056455, with translation.
Notification of Grounds for Refusal dated Nov. 29, 2016 in corresponding Korean Application No. 10-2016-7015953, with English Translation.

* cited by examiner

PUSH-BUTTON SWITCH

TECHNICAL FIELD

The present invention relates to a side-push push-button switch.

BACKGROUND ART

As a conventional side-push push-button switch, as disclosed in patent documents 1 and 2, there has been known a push-button switch including a switch contact, a push-button member, and a housing. The switch contact is made up of a fixed contact and a movable contact. The push-button member presses the switch contact. The housing has an opening in which this push-button member is inserted. The housing is made of resin and accommodates the switch contact. A plurality of electrode portions to electrically connect to the fixed contact are formed on a rear surface of the housing. An inclined guide portion is disposed in the housing and inclined toward the center of the movable contact. In the push-button switch of this configuration, when the push-button member is pressed, the distal end of the push-button member abuts against the inclined guide portion and is guided down along the inclined guide portion to bring the movable contact into contact with the fixed contact. A horizontal slide movement of the push-button member is transmitted to the elastic movable contact through the inclined guide portion. This enables ON-OFF operation of the movable contact and the fixed contact.

The push-button switch of this configuration has the housing surrounded by a metal holding frame. This holding frame is secured to a circuit board by soldering. Since the push-button switch is used as a side switch of a small-size digital device such as a cellular phone, there is a demand for thinning the push-button switch. Consequently, there has been often employed a surface mounting method by which the thickness of the push-button switch mounted on the circuit board is decreased. In this surface mounting, reflow processing is performed to secure and electrically connect the push-button switch to the motherboard at the same time.

RELATED ART DOCUMENTS

Patent Documents

[Patent document 1] Japanese Unexamined Patent Application Publication No. 2006-244977.

[Patent document 2] Japanese Unexamined Patent Application Publication No. 2005-209565.

DISCLOSURE OF THE INVENTION

Problems to be Solved by the Invention

Since side-push operation of the push-button switch of the above-described configuration is performed from one side, a load from outside force caused by ON-OFF operation of the switch contact is applied to the rear side of the housing. Therefore, in order to stably mount the housing on the circuit board, it is necessary to secure strength of the outer surfaces of the housing, in particular, strength of the rear surface of the housing.

Conventionally, the outer surfaces of the housing were surrounded by a channel-shaped holding frame, and the lower end of the holding frame was soldered on the circuit board to strengthen coupling of the housing and the circuit board to each other. In patent documents 1 and 2, however, the holding frame is attached to the housing in such a manner that the holding frame surrounds the housing from the front side of the housing where the push-button member is disposed to the rear side of the housing where the switch contact is housed. Thus, both ends of the holding frame are located on the rear side of the housing. With both the ends of the holding frame being located on the rear side of the housing in this manner, there were cases in which mounting defects with respect to the circuit board occurred. For example, due to pressure caused when the push-button member is pushed from the front side of the housing, the positions of both the ends of the holding frame were displaced, and a gap was formed between both the ends of the holding frame.

Such a side-push push-button switch is often used as a side operation switch of a small-size digital device such as a cellular phone and mainly carried on person. Consequently, when the push-button switch receives a strong impact when dropped, for example, there was a possibility that the push-button switch may be destroyed mechanically or electrically. For example, the housing that accommodates the switch contact may detach from the circuit board.

In the conventional side-push push-button switch, when high outside pressure due to a factor such as excessive switch operation and dropping is applied to the push-button member, the load concentrates on the rear side of the housing. As a result, there was a possibility that reliability as the push-button switch may be degraded. For example, defective electric connection may be caused between the switch contact and the circuit board, and the switching function may deteriorate.

It is therefore an object of the present invention to provide a side-push push-button switch in which the strength of the rear side of a housing on which a load from outside force caused by switching operation of a push-button member is particularly applied is increased to stably mount the housing on a circuit board and to perform reliable and secure switching operation.

Means of Solving the Problems

In order to solve the above-described problems, a push-button switch according to the present invention includes a housing, a push-button member, and a holding frame. The housing accommodates a switch contact. The push-button member is disposed on a front surface of the housing and configured to press the switch contact. The holding frame of a channel shape covers outer surfaces of the housing. Both ends of the holding frame are secured to the front surface of the housing on both sides of the push-button member.

In the push-button switch according to the present invention, the front surface of the housing may include a front-surface center portion and front-surface side portions. The push-button member is disposed in the front-surface center portion. The front-surface side portions are located on both sides of the front-surface center portion with stepped portions interposed between the front-surface center portion and the front-surface side portions. The front-surface center portion protrudes more forwardly than the front-surface side portions. Both the ends of the holding frame are secured to the front-surface side portions of the housing.

In the push-button switch according to the present invention, the holding frame may include a rear-surface frame portion, side-surface frame portions, and front-surface frame portions. The rear-surface frame portion is configured to cover a rear surface of the housing. The side-surface frame portions are configured to respectively cover left and right side surfaces of the housing. The front-surface frame portions are configured to cover the front surface of the housing except the push-button member.

The holding frame may further include a reinforcement rib that horizontally extends on the rear-surface frame portion.

Effects of the Invention

In the push-button switch according to the present invention, the housing of the push-button switch is covered with the channel-shaped holding frame, and both the ends of the holding frame are secured to the front surface of the housing on both sides of the push-button member. Consequently, the whole rear surface of the housing is covered with the holding frame in such a manner that when the push-button member is switched, a load applied to the rear surface side of the housing is received by the holding frame. This increased the strength of the housing on the rear side.

The stepped portions are disposed between the front-surface center portion of the housing in which the push-button member is disposed and the front-surface side portions of the housing to which both the ends of the holding frame are secured. Consequently, when the push-button switch is mounted on the circuit board, even if flux generated by melting the solder enters the inside of the holding frame by capillary action, for example, the flux does not further spread around to the front-surface center portion of the housing.

The reinforcement rib extending horizontally is disposed on the rear-surface frame portion of the holding frame. This made it possible to further increase the strength of the holding frame against bending deformation and also to decrease the thickness of the metal plate of which the holding frame is formed.

MODE FOR CARRYING OUT THE INVENTION

Figure 2:
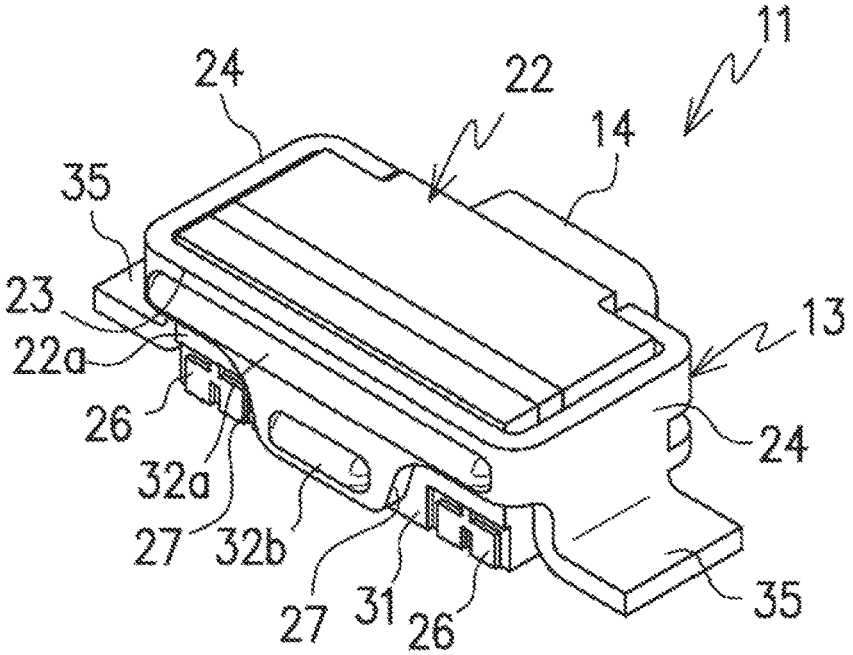
FIG. 2 is a perspective view of the push-button switch, as viewed from the rear side.
Figure 3:
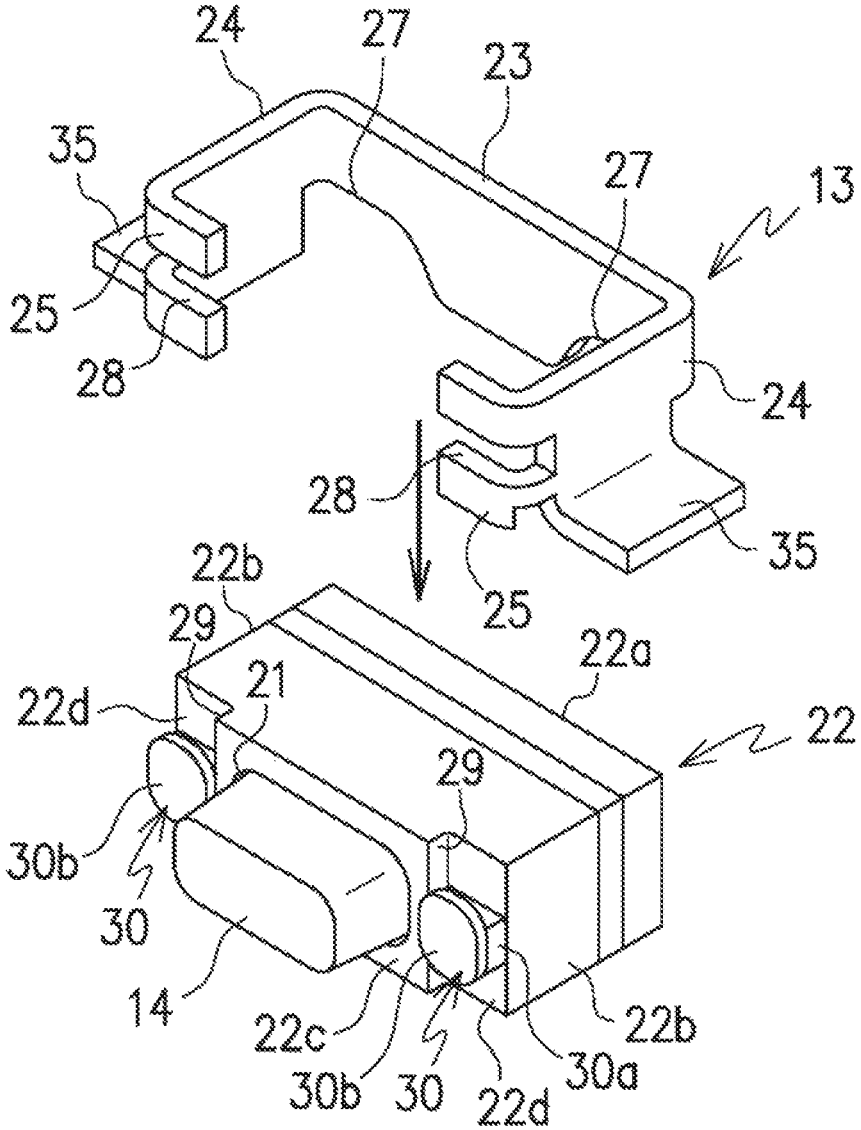
FIG. 3 is a perspective view of a housing and a holding frame of the push-button switch separate from each other.
Figure 4:
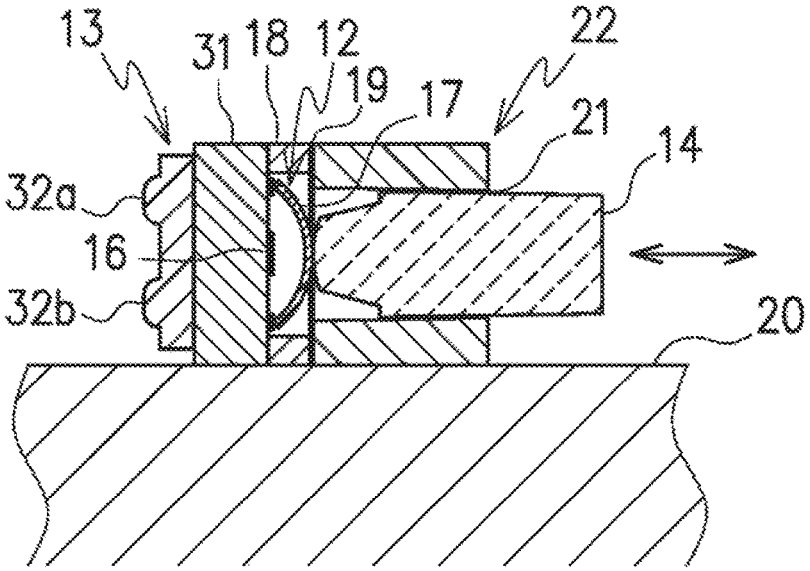
FIG. 4 is a cross-sectional view of the push-button switch mounted on a circuit board.

FIG. 1 to FIG. 5 illustrate a first embodiment of a push-button switch according to the present invention. The push-button switch 11 according to this embodiment includes a housing 22 and a holding frame 13. The housing 22 accommodates a switch contact 12 (see FIG. 4) and slidably holds a push-button member 14 to switch the switch contact 12. The holding frame 13 has a channel shape to surround and cover outer surfaces of the housing 22. As illustrated in FIG. 4, the push-button switch 11 is mounted on a circuit board 20 in such a manner that the push-button member 14 is slidable horizontally.

As illustrated in FIG. 4, the switch contact 12 includes a switch board 31, a fixed contact 16, and a movable contact 17. The switch board 31 is arranged to be perpendicular to the circuit board 20. The fixed contact 16 is disposed on an inner surface of the switch board 31. The movable contact 17 is made of a tactile spring and arranged to cover the fixed contact 16. An adhesive sheet 18 and a waterproof sheet 19 are disposed on the switch contact 12. The adhesive sheet 18 is disposed to surround the movable contact 17. The waterproof sheet 19 is disposed on the adhesive sheet 18 and in contact with the top of the movable contact 17.

Figure 5:
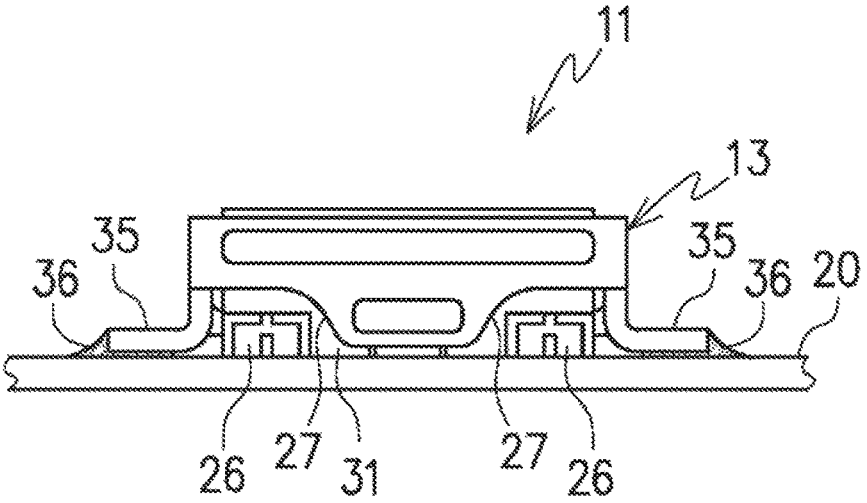
FIG. 5 is a side view of the push-button switch mounted on the circuit board.

The switch board 31 is made of a resin such as glass epoxy. A switch circuit made up of the fixed contact 16 and the movable contact 17, and a wiring pattern are disposed on the surface of the switch board 31. A plurality of electrode portions 26 are formed from this surface to the rear surface. The electrode portions 26 are disposed in four corners of the switch board 31. As illustrated in FIG. 5, a pair of electrode portions 26 located on both sides of the lower portion of the switch board 31 are soldered on an electrode pattern (not illustrated) formed on the circuit board 20.

The movable contact 17 is a conductive leaf spring, which is formed of a thin elastic metal material such as stainless steel (SUS) and brass and which has a dome shape. The movable contact 17 has a center portion that comes in contact with the fixed contact 16. In a normal state, the center portion of the movable contact 17 is held not in contact with the fixed contact 16, and positioned in the center of the switch board 31 by the adhesive sheet 18.

Figure 1:
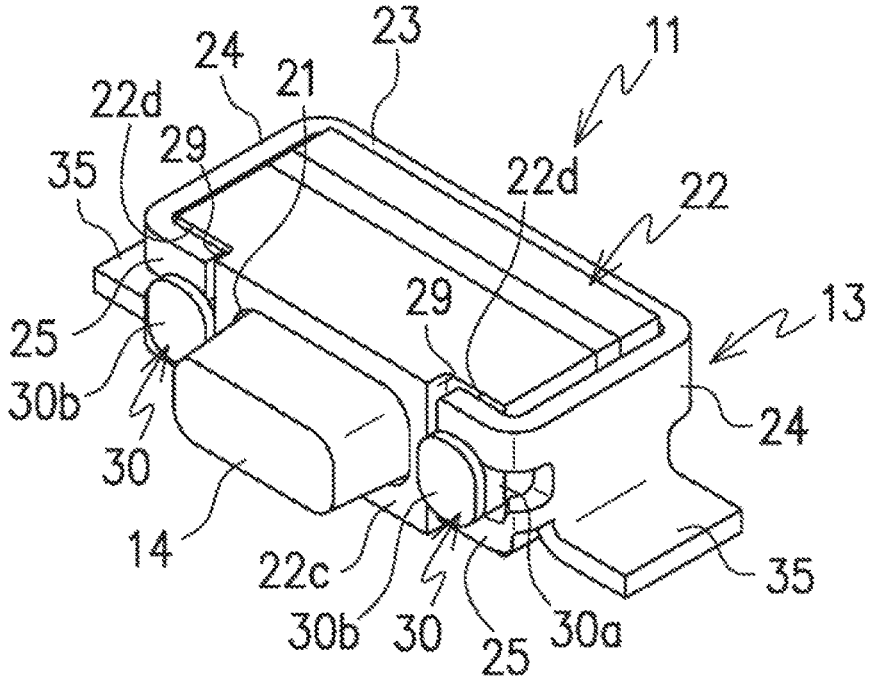
FIG. 1 is a perspective view of a push-button switch according to the present invention, as viewed from the front side.

As illustrated in FIG. 1 and FIG. 3, the housing 22 is made of an insulating mold resin and has a rectangular shape having longer lateral sides. The housing 22 has an opening 21 that is formed in the front surface so as to slidably hold the push-button member 14. The front surface of the housing 22 includes a front-surface center portion 22*c* and front-surface side portions 22*d*. The push-button member 14 is disposed in the front-surface center portion 22*c*. The front-surface side portions 22*d* are located on both sides of the front-surface center portion 22*c*, with stepped portions 29 on both sides of the front-surface center portion 22*c* being interposed between the front-surface center portion 22*c* and the front-surface side portions 22*d*. The front-surface center portion 22*c* protrudes more forwardly than the front-surface side portions 22*d* by a height corresponding to the height of the stepped portion 29. A pair of engagement protrusions 30 are respectively formed on the pair of front-surface side portions 22*d* on the left and right sides with the front-surface center portion 22*c* interposed between the engagement protrusions 30. The engagement protrusions 30 serve for securing the holding frame 13 to the housing 22. Each of the engagement protrusions 30 includes a shaft portion 30*a* and an enlarged portion 30*b*. The shaft portion 30*a* protrudes forwardly from the front-surface side portion 22*d*. The enlarged portion 30*b* is disposed on the distal end of the shaft portion 30*a*.

The push-button member 14 is made of a block-shaped resin member inserted in the opening 21 of the housing 22. The push-button member 14 is slidably held in the opening 21 of the housing 22. The push-button member 14 has one end in contact with the movable contact 17 and has the other end protruding outwardly from the opening 21 of the housing 22. When the other end of the push-button member 14 is pressed, the push-button member 14 is elastically pressed into the housing 22 so as to make the one end of the push-button member 14 press a portion of the movable contact 17 in the vicinity of the top of the dome shape. When pressing the other end of the push-button member 14 is stopped, the push-button member 14 elastically returns to its original position. The movable contact 17 when pressed and deformed by the push-button member 14 comes into contact with the fixed contact 16 to electrically connect the switch contact 12.

The holding frame 13 is made of a single metal plate of predetermined strength and elasticity that is bent into a channel shape. The holding frame 13 covers the housing 22 in close contact with the outer surfaces of the housing 22. The holding frame 13 is secured to the circuit board 20 while holding the housing 22. Specifically, as illustrated in FIG. 3, the holding frame 13 includes a rear-surface frame portion 23, a pair of side-surface frame portions 24, and a pair of front-surface frame portions 25. The rear-surface frame portion 23 covers a rear surface 22*a* of the housing 22. The side-surface frame portions 24 respectively cover left and right side surfaces 22*b* of the housing 22. The front-surface frame portions 25 respectively cover the front-surface side portions 22*d* except the front-surface center portion 22*c* of the housing 22 in which the push-button member 14 is disposed. The holding frame 13 has a channel shape as a whole in a plan view.

As illustrated in FIG. 2, in order to expose the pair of electrode portions 26 on both sides of the lower portion of the rear surface 22*a* of the housing 22, the rear-surface frame portion 23 includes notches 27 each having a shape corresponding to the electrode portion 26. Horizontal flanges 35 outwardly bent in an L-shape are respectively formed on the lower ends of the pair of side-surface frame portions 24. As illustrated in FIG. 3, each of the front-surface frame portions 25 includes an engagement groove 28 to engage with the engagement protrusion 30 protruding from the front-surface side portion 22*d* of the housing 22. The engagement groove 28 is formed of a large notch having longer lateral sides approximately in the center of the front-surface frame portion 25. The shaft portion 30*a* of the engagement protrusion 30 is fitted in the engagement groove 28, and the upper and lower inner edges of the engagement groove 28 are elastically engaged with the enlarged portion 30*b* of the engagement protrusion 30. Thus, the holding frame 13 is secured to the housing 22.

As illustrated in FIG. 3, the holding frame 13 is bent approximately in the channel shape. When the holding frame 13 is fitted on the housing 22, the pair of front-surface frame portions 25 are first pulled outwardly. With the front-surface frame portions 25 spread elastically, the holding frame 13 is fitted from the rear surface 22*a* side of the housing 22 so as to cover the rear surface 22*a* and the pair of side surfaces 22*b* of the housing 22 with the rear-surface frame portion 23 and the pair of side-surface frame portions 24 of the holding frame 13. Next, while the pair of front-surface frame portions 25 elastically spread are made to return to their original states on the front-surface side portions 22*d* of the housing 22, the engagement protrusions 30 protruding from the front-surface side portions 22*d* of the housing 22 are fitted in the engagement grooves 28 of the front-surface frame portions 25. Thus, the front-surface frame portions 25 are engaged with the engagement protrusions 30. In this manner, the holding frame 13 covers the housing 22 with the rear-surface frame portion 23, the side-surface frame portions 24, and the front-surface frame portions 25 respectively in close contact with the rear surface 22*a*, both of the side surfaces 22*b*, and the front-surface side portions 22*d* of the housing 22. The engagement protrusions 30 are engaged with the engagement grooves 28 in both ends of the front-surface frame portions 25. Thus, the holding frame 13 is reliably secured to the housing 22.

The thickness of the metal plate of which the holding frame 13 is formed is made to be approximately equal to the height of the stepped portion 29 on each side of the front-surface center portion 22*c* of the housing 22. This makes it possible to flatten the front surface of the housing 22 approximately as a single plane as a whole when the holding frame 13 is fitted on the housing 22. It is noted that when the housing 22 including the engagement protrusions 30 is made of a metal member, both ends of each of the front-surface frame portion 25 of the holding frame 13 and the engagement protrusion 30 can also be swaged with each other. In this case, the holding frame 13 can be secured more firmly.

As described above, the housing 22 is covered with the channel-shaped holding frame 13, and both ends of the holding frame 13 are secured to the housing 22 on the front-surface side of the housing 22. Consequently, the rear-surface frame portion 23 of the holding frame 13 is in close contact with the whole rear surface 22*a* of the housing 22, and also, the whole rear surface 22*a* of the housing 22 is covered with the rear-surface frame portion 23. This makes it possible to increase the strength of the housing 22 on the rear surface 22*a* side. When the push-button member 14 is switched, a load applied to the rear surface 22*a* of the housing 22 can be fully received by the holding frame 13. Moreover, the rear-surface frame portion 23, the pair of side-surface frame portions 24, and the pair of front-surface frame portions 25 of the holding frame 13 integrally surround and cover the outer surfaces of the housing 22. In particular, this makes it possible to effectively protect the whole housing 22 even from various impacts from the side of the push-button member 14 that is exposed to the outside.

As illustrated in FIG. 2, the holding frame 13 in this embodiment further includes two reinforcement ribs 32*a* and 32*b*, which are disposed on the rear-surface frame portion 23 that covers the rear surface 22*a* of the housing 22. The two reinforcement ribs 32*a* and 32*b* are two upper and lower protrusions linearly extending side by side, which are formed by embossing the rear-surface frame portion 23 to press the inner surface to make it protrude toward the outer surface. The two reinforcement ribs 32*a* and 32*b* are horizontally disposed in parallel to each other. The upper reinforcement rib 32*a* extends over approximately the entire width of the rear-surface frame portion 23 so as to reinforce the whole rear surface 22*a* of the housing 22. The lower reinforcement rib 32*b* is shorter than the reinforcement rib 32*a* and disposed between the pair of notches 27. These reinforcement ribs 32*a* and 32*b*, which are disposed on the upper and lower sides of the rear-surface frame portion 23, can increase the strength of the holding frame 13. When the push-button member 14 is frequently pushed and when the push-button member 14 and the housing 22 themselves receive a strong impact from the outside, it is possible to effectively prevent the rear-surface frame portion 23 from being bent and deformed and the rear surface 22*a* of the housing 22 and the housing 22 itself from being broken.

In the description of the above-described embodiment, the reinforcement ribs 32*a* and 32*b* are made to protrude from the outer surface of the rear-surface frame portion 23. In the present invention, however, the reinforcement ribs 32*a* and 32*b* may be made to protrude from the inner surface of the rear-surface frame portion 23. This is because the same effect can be obtained. It is noted that shapes, numbers, lengths, and directions, for example, of the reinforcement ribs are desirably selected in accordance with the size and shape of the housing 22, and frequency of switching the push-button member 14, for example.

The holding frame 13 according to this embodiment includes the horizontal flanges 35 integral to the holding frame 13. The horizontal flanges 35 are bent outwardly in L-shapes from the lower ends of the pair of side-surface frame portions 24. As illustrated in FIG. 5, therefore, when the push-button switch 11 is mounted on the circuit board 20, the horizontal flanges 35 are secured to the upper surface of the circuit board 20 by solder 36 so as to perform reflow mounting.

Figure 6:
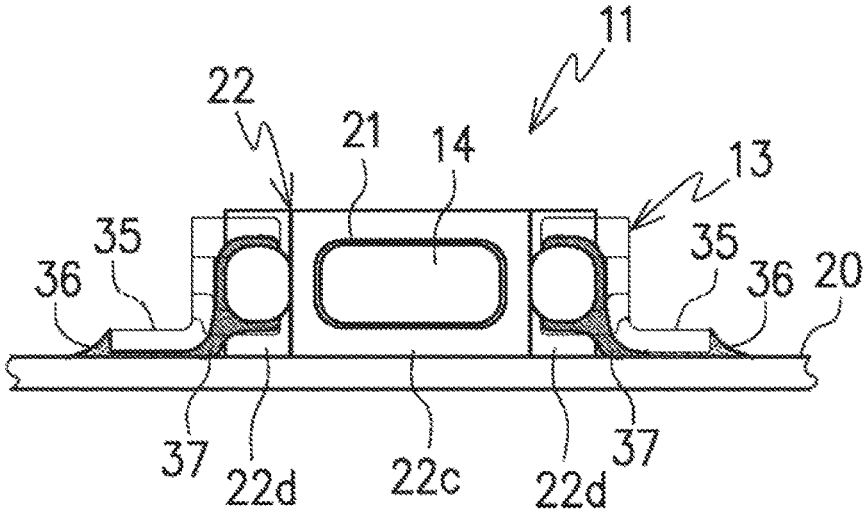
FIG. 6 is a front view illustrating an example in which flux enters the push-button switch when the push-button switch is soldered.
Figure 7:
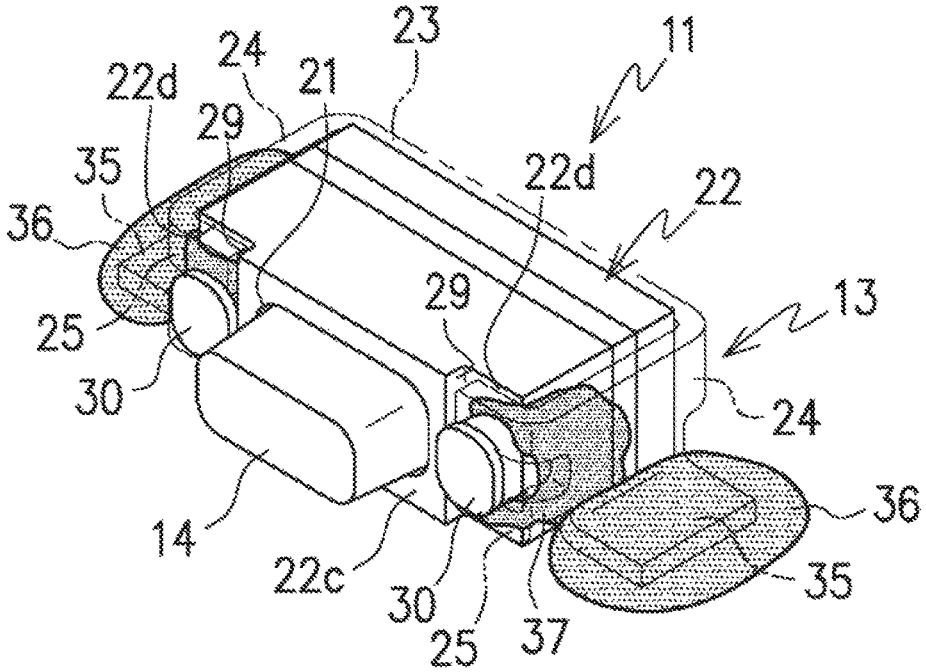
FIG. 7 is a perspective view illustrating the example in which flux enters the push-button switch when the push-button switch is soldered.

As illustrated in FIG. 6 and FIG. 7, in the reflow mounting of the push-button switch 11 on the upper surface of the circuit board 20, the solder 36 is placed on each of the horizontal flanges 35 as the center and in its vicinity. Flux 37, generated when the solder 36 is melted, may enter the holding frame 13 along its inner surface by capillary action and spread inside of the side-surface frame portion 24 and the front-surface frame portion 25 of the holding frame 13. Even in this case, in the present invention, the engagement groove 28 of the front-surface frame portion 25 of the holding frame 13 engages with the engagement protrusion 30 at a position separate from the front-surface center portion 22*c* of the housing 22, and also, the stepped portion 29 is disposed between the front-surface side portion 22*d* of the housing 22 on which the engagement protrusion 30 is disposed and the front-surface center portion 22*c*. Consequently, the flux 37, which has spread inside of the front-surface frame portion 25 of the holding frame 13, does not further spread around to the front-surface center portion 22*c* of the housing 22. As a result, it is possible to reliably prevent the flux 37 from entering the housing 22 through the gap between the push-button member 14 and the opening 21. This prevents the switch contact 12 and the switch board 31 (see FIG. 4), for example, housed in the housing 22 from being affected by the flux 37.

As described above, while the channel-shaped holding frame 13 made of the single metal plate surrounds and covers the rear surface 22*a*, the side surfaces 22*b*, and the front-surface side portions 22*d* of the housing 22, the holding frame 13 does not cover the front-surface center portion 22*c* in which the push-button member 14 is disposed. Consequently, even if the flux 37 spreads all over the inside of the holding frame 13, the flux 37 does not further spread around to the front-surface center portion 22*c* in which the opening 21 of the housing 22 is formed.

Figure 8:
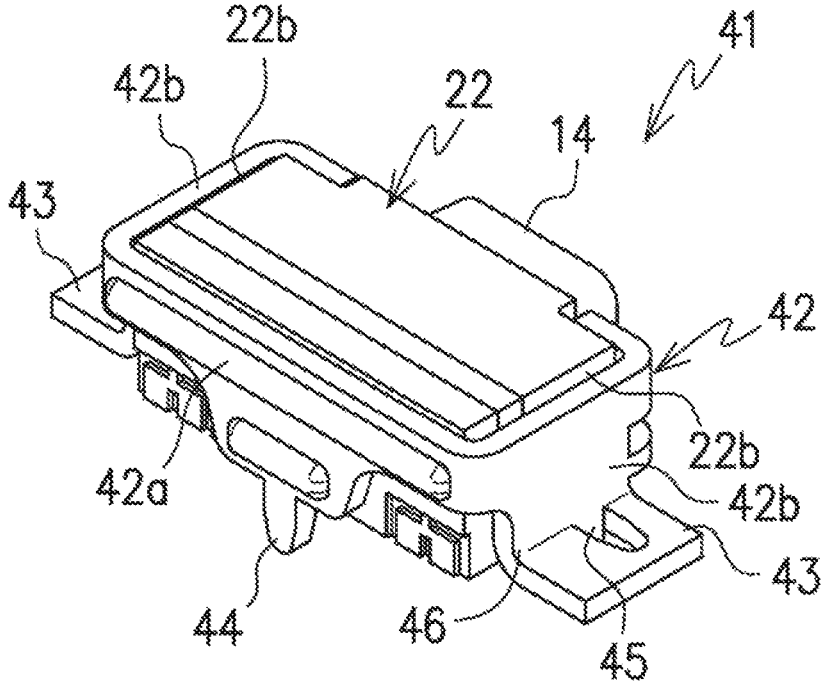
FIG. 8 is a perspective view of a push-button switch including a holding frame provided with first and second reinforcement pins.

FIG. 8 illustrates a second embodiment of a push-button switch according to the present invention. The push-button switch 41 according to this embodiment includes a plurality of reinforcement pins on a holding frame 42 to facilitate positioning with respect to the circuit board 20 (see FIG. 5) and increase the mounting strength. Specifically, a first reinforcement pin 44 is formed on the lower end of the center of a rear-surface frame portion 42*a* of the holding frame 42 and protrudes downwardly. A second reinforcement pin 45 is formed on the lower end of the center of each of a pair of side-surface frame portions 42*b* and protrudes downwardly. A horizontal flange 43, which extends outwardly from the lower end of the side-surface frame portion 42*b* in an L-shape, is partially cut and bent downwardly to form the second reinforcement pin 45. The second reinforcement pins 45 facilitate positioning and attachment of the housing 22 with respect to the circuit board 20 (see FIG. 5). Moreover, since the first reinforcement pin 44 and the second reinforcement pins 45 are integral to the holding frame 42, attachment strength of the holding frame 42 to the circuit board 20 is increased, and also, switching operation by the push-button member 14 is stabilized. It is noted that the housing 22 has the same configuration as the first embodiment, and therefore, the same reference numerals are used to omit detailed description.

The push-button switches 11 and 41 described above are often used as side switches for cellular phones and information terminals, for example, that have been reduced in thickness and size. For this purpose, the push-button switches 11 and 41 according to the present invention are respectively covered with the channel-shaped holding frames 13 and 42 to reinforce the rear surface 22*a* side of the housing 22 to which the largest load is applied at the time of switching operation of the push-button member 14. With this configuration, stable switching operation was constantly ensured to enhance reliability as the push-button switch.

DESCRIPTION OF THE REFERENCE NUMERAL

11 Push-button switch
12 Switch contact
13 Holding frame
14 Push-button member
16 Fixed contact
17 Movable contact
18 Adhesive sheet
19 Waterproof sheet
20 Circuit board
21 Opening
22 Housing
22*a* Rear surface
22*b* Side surface
22*c* Front-surface center portion
22*d* Front-surface side portion
23 Rear-surface frame portion
24 Side-surface frame portion
25 Front-surface frame portion
26 Electrode portion
27 Notch
28 Engagement groove
29 Stepped portion
30 Engagement protrusion
30*a* Shaft portion
30*b* Enlarged portion
31 Switch board
32*a*, 32*b* Reinforcement rib
35 Horizontal flange
36 Solder
41 Push-button switch
42 Holding frame
42*a* Rear-surface frame portion
42*b* Side-surface frame portion
43 Horizontal flange
44 First reinforcement pin
45 Second reinforcement pin

The invention claimed is:

1. A push-button switch comprising:

a housing accommodating a switch contact, the housing comprising a front surface having a front-surface center portion and front-surface side portions located on both sides of the front-surface center portion with stepped portions interposed between the front-surface center portion and the front-surface side portions, the front-surface center portion protruding further forward than the front-surface side portions;

a push-button member disposed in the front-surface center portion of the housing and configured to press the switch contact; and a holding frame of a channel shape that covers outer surfaces of the housing, both ends of the holding frame being secured to the front-surface side portions of the housing, wherein the front-surface side portions of the housing include engagement protrusions disposed thereon, each of the engagement protrusions including a shaft portion and an enlarged portion, the shaft portions protrude outwardly from the front-surface side portions, and the enlarged portions are disposed on distal ends of the shaft portions, the ends of the holding frame have engagement grooves formed therein, the engagement grooves configured to engage with the engagement protrusions, and the holding frame is secured to the housing with the shaft portions of the engagement protrusions fitted in the engagement grooves.

2. The push-button switch according to claim 1, wherein when both of the ends of the holding frame are secured to the front-surface side portions of the housing, both of the ends of the holding frame have surfaces on a same plane as the front-surface center portion of the housing.

3. The push-button switch according to claim 1, wherein the holding frame comprises a rear-surface frame portion configured to cover a rear surface of the housing, side-surface frame portions configured to respectively cover left and right side surfaces of the housing, and front-surface frame portions configured to cover the front surface of the housing except the push-button member.

4. The push-button switch according to claim 3, wherein the holding frame comprises a first reinforcement pin protruding downwardly from a lower end of the rear-surface frame portion.

5. The push-button switch according to claim 3, wherein the holding frame comprises horizontal flanges bent outwardly from respective lower ends of the side-surface frame portions, and second reinforcement pins protruding downwardly from respective lower ends of the horizontal flanges.

6. The push-button switch according to claim 3, wherein when both of the ends of the holding frame are secured to the front-surface side portions of the housing, both of the ends of the holding frame have surfaces on a same plane as the front-surface center portion of the housing.

7. The push-button switch according to claim 1, wherein the holding frame comprises a reinforcement rib on a rear-surface frame portion.

8. The push-button switch according to claim 7, wherein the reinforcement rib extends horizontally linearly.

9. The push-button switch according to claim 7, wherein the reinforcement rib comprises a plurality of reinforcement ribs.

10. The push-button switch according to claim 8, wherein the reinforcement rib comprises a plurality of reinforcement ribs.

11. The push-button switch according to claim 1, wherein the holding frame is made of a single metal plate in a channel shape.

* * * * *